US008160488B2

(12) United States Patent
Honmochi et al.

(10) Patent No.: US 8,160,488 B2
(45) Date of Patent: Apr. 17, 2012

(54) IMAGE FORMATION PROCESSING SYSTEM APPLYING ADHESIVE TO RECEIVED SHEETS IN A BUNDLE FORM

(75) Inventors: Hiroki Honmochi, Moriya (JP); Masayoshi Kubo, Toride (JP); Toshiaki Nochi, Mitsukaido (JP); Ken Yonekawa, Moriya (JP); Yuji Ueno, Moriya (JP); Keiichi Nagasawa, Alps (JP); Hiroshi Nakagomi, Alps (JP)

(73) Assignees: Canon Finetech Inc., Ibaraki-Ken (JP); Nisca Corporation, Yamanashi-Ken (JP)

( * ) Notice: Subject to any disclaimer, the term of this patent is extended or adjusted under 35 U.S.C. 154(b) by 513 days.

(21) Appl. No.: 11/131,818

(22) Filed: May 17, 2005

(65) Prior Publication Data

US 2005/0265765 A1 Dec. 1, 2005

(30) Foreign Application Priority Data

May 28, 2004 (JP) ..... 2004-158722

(51) Int. Cl.
*G03G 15/00* (2006.01)

(52) U.S. Cl. ..... 399/408; 399/407; 412/18; 412/19; 412/37

(58) Field of Classification Search ..... 399/408, 399/407, 409, 410; 270/21.1, 5.02, 32, 52.17, 270/52.18, 58.05; 412/15, 4, 8, 18, 19, 37; 156/908

See application file for complete search history.

(56) References Cited

U.S. PATENT DOCUMENTS

| | | | | |
|---|---|---|---|---|
| 4,586,640 | A * | 5/1986 | Smith | 227/14 |
| 5,377,965 | A * | 1/1995 | Mandel et al. | 270/37 |
| 5,735,659 | A * | 4/1998 | Kosasa et al. | 412/9 |
| 6,000,894 | A * | 12/1999 | Suzuki et al. | 412/11 |
| 6,616,315 | B2 * | 9/2003 | Albou | 362/518 |
| 6,685,416 | B2 * | 2/2004 | Itoh et al. | 412/37 |
| 6,717,286 | B2 * | 4/2004 | Tsuchiya et al. | 270/58.07 |
| 6,910,686 | B2 * | 6/2005 | Awano | 270/37 |
| 6,966,553 | B2 * | 11/2005 | Rathert | 270/52.18 |
| 7,020,430 | B2 * | 3/2006 | Kudo et al. | 399/382 |
| 2007/0047998 | A1 * | 3/2007 | Watanabe et al. | 399/88 |
| 2007/0085256 | A1 * | 4/2007 | Miyake et al. | 270/52.18 |

FOREIGN PATENT DOCUMENTS

| | | |
|---|---|---|
| JP | 7172666 A | 7/1995 |
| JP | 2002-326473 | 12/2002 |
| JP | 2003-103959 A | 4/2003 |

* cited by examiner

*Primary Examiner* — Matthew G Marini
(74) *Attorney, Agent, or Firm* — Michaud-Kinney Group LLP

(57) ABSTRACT

An image formation processing system is provided with an image formation portion, an adhesive applying portion which receives a plurality of sheets from the image formation portion, gathers the received sheets in the shape of a bundle to form a sheet bundle, and applies an adhesive to an end face of the sheet bundle, and a post-processing portion which receives a plurality of sheets from the image formation portion, gathers the received sheets in the shape of a bundle to form a sheet bundle, and performs predetermined post-processing on the sheet bundle, where the adhesive applying portion is disposed downstream of the image formation portion in the sheet transport, while the post-processing portion is disposed downstream of the adhesive applying portion in sheet transport.

11 Claims, 6 Drawing Sheets

IMAGE FORMATION PROCESSING SYSTEM APPLYING ADHESIVE TO RECEIVED SHEETS IN A BUNDLE FORM

BACKGROUND OF THE INVENTION

1. Field of the Invention

The present invention relates to an image formation processing system provided with an image formation apparatus such as a copy machine, a bookbinding apparatus to make a bundle of sheets from the image formation apparatus and the like to bind, and a post-processing apparatus that performs post-processing such as stapling on the sheets.

2. Description of Related Art

Conventionally, an image formation processing system has been known which forms an image in an image formation portion, transfers the image to a sheet, i.e. prints the image, and performs post-processing such as stapling processing on a bundle of a plurality of sheets with images printed thereon.

For example, an image formation processing system has been disclosed that is integrally provided with an image formation portion that forms an image and transfers the image to a sheet, a stapling processing portion that performs stapling processing on sheets with images transferred in the image formation portion, and a gluing processing portion that performs gluing processing on the sheets with the images transferred thereto.

In the image formation processing system with a plurality of processing portions, the processing time required for each processing portion differs corresponding to the type of processing.

For example, in the stapling processing portion that performs stapling processing on sheets, after the sheets are gathered in the shape of a bundle and aligned, it is possible to immediately staple the sheet bundle and then, immediately convey the sheet bundle to downstream portions. Further, in the stapling processing portion, the staple is limited in its size, limiting the number of sheets to be stapled, and therefore, relatively short time is required to gather the sheets in the shape of a bundle.

In contrast thereto, in the gluing processing portion that performs gluing processing on the sheets, sheets are gathered in the shape of a bundle to form a bundle sheet, glue is applied to an end face of the sheet bundle, and it is not possible to convey the sheet bundle to downstream portions until the applied glue is dried. The processing time is longer than that of the stapling processing portion. Further, in the gluing processing portion, it is possible to glue a larger number of sheets than that of sheets that the stapling processing portion can staple (because of no limitations unlike size in stapling), and therefore, there is a case that the time required to gather sheets in the shape of a bundle is longer than in the stapling processing portion.

The gluing processing portion requiring longer processing time has conventionally been situated on the downstream side of the stapling processing portion, and spaced the furthest from the image formation portion. Therefore, after image formation (image transfer) is finished in the image formation portion, in addition to the net time to perform the gluing processing, extra time is required to complete the gluing processing until the gluing processing is completed, because it is necessary to convey the sheet to the gluing processing portion via the stapling processing portion. In the gluing processing that already requires the longer time for processing therein, adopting such a form of transport purposely via the stapling processing portion delays the gluing operation uselessly, and particularly, a problem arises in the case where bookbinding processing including cutting of sheets and the like is performed in the gluing processing portion.

Further, when a transport path is long from the image formation portion to the gluing processing portion, the risk is increased of occurrences of the so-called jam such that a sheet is blocked during transport, and in this case, not only the gluing processing (or bookbinding processing) is halted, but also all the sheets gathered in the shape of a bundle are wasted. When such a case occurs, as described previously, since the number of sheets enabling the processing (gathering) in the gluing processing portion is generally larger than the number of sheets enabling the processing (gathering) in the stapling processing portion, the number of sheets to be wasted due to the jam is larger also in the gluing processing portion than in the stapling processing portion.

SUMMARY OF THE INVENTION

In view of the problems of the conventional techniques in the foregoing, it is an object of the present invention to provide an image formation processing system capable of implementing a series of bookbinding processing including gluing processing in a shorter time with higher efficiency and more reliability than in the conventional techniques In order to achieve the object, an image formation processing system of the present invention has an image formation portion that forms an image to transfer to a sheet, an adhesive applying portion which receives a plurality of sheets with images transferred thereto from the image formation portion, gathers the received sheets in the shape of a bundle to form a sheet bundle, and applies an adhesive to an end face of the sheet bundle, a post-processing portion which receives a plurality of sheets with images transferred thereto from the image formation portion, gathers the received sheets in the shape of a bundle to form a sheet bundle, and performs predetermined post-processing on the sheet bundle, and transport means for conveying the sheet from the image formation processing portion to the adhesive applying portion and the post-processing portion, where the adhesive applying portion is disposed downstream of the image formation portion in sheet transport, while the post-processing portion is disposed downstream of the adhesive applying portion in sheet transport.

According to the image formation processing system, the adhesive applying portion is disposed downstream of the image formation portion in sheet transport, while the post-processing portion is disposed downstream of the adhesive applying portion in sheet transport. In other words, the adhesive applying portion requiring relatively long processing time is disposed closer to the image formation portion than the other post-processing portion. Accordingly, a sheet fed out of the image formation portion is directly supplied to the adhesive applying portion without troubling to pass through the post-processing portion, and it is thereby possible to reduce the time taken to convey a sheet from the image formation portion to the adhesive applying portion, and shorten the time required for the entire adhesive applying processing. It is thus possible to perform the adhesive applying processing in a shorter time with higher efficiency than in conventional systems.

Further, since the sheet transport path from the image formation portion to the adhesive applying portion is shorter than in conventional systems, it is made possible to reduce the risk of occurrences of the so-called jam such that a sheet is blocked during transport, and reliable adhesive applying processing can be implemented, while preventing a sheet from being wasted due to the jam.

In addition, examples as the processing carried out in the post-processing portion include processing for stapling sheets to bind and processing for punching sheets, which is processing having relatively shorter processing time than in the adhesive applying processing and bookbinding processing.

The image formation processing system is particularly useful in the case where the adhesive applying portion constitutes part of a bookbinding section that binds the sheet bundle, and the bookbinding section includes a cutting portion that cuts an end face of the sheet bundle, and a storage portion that gathers and stores the sheet bundle that is bound and cut in the cutting portion, i.e. adhesive application is associated with a series of bookbinding processing including cutting and storage and requires long processing time. In this case, the bookbinding section may be further provided with a front cover bonding portion that bonds a front cover to the end face of the sheet bundle applied with the adhesive. Further in this case, the front cover bonding portion preferably bonds a front cover to the end face of the sheet bundle applied with the adhesive, while letting the sheet bundle stand in the substantially vertical direction. In this way, since such bonding can be carried out that the sheet bundle is pressed against the front cover with the end face applied with the adhesive down, even if the adhesive drips, the adhesive is received on the front cover, and the risk is eliminated of occurrences of trouble due to the adhesive adhering to other parts of the apparatus. The front cover supplied to the front cover bonding portion may be sent from the image formation portion, or from front cover supplying means disposed independently of the image formation portion.

The cutting portion includes cutting the end face of the sheet bundle while letting the sheet bundle stand in the substantially vertical direction. Thus, in the image formation processing system, when the sheet bundle applied with the adhesive is cut in the cutting portion, the end face of the sheets is cut while the bundle is allowed to stand in the substantially vertical direction. Therefore, the direction (vertical direction) of the adhesive dripping due to gravity is perpendicular to the cutting direction (shift direction) of a cutting blade. Accordingly, as compared to the case where the adhesive dripping direction agrees with the cutting direction (shift direction) of the cutting blade (the case where the sheet bundle is cut while being allowed to lie horizontally), occasions can be reduced extremely such that the adhesive dripped in cutting adheres to the cutting blade, and it is made possible to minimize such an event that the adhered adhesive degrades subsequent cutting function of the cutting blade.

Further, the storage portion includes gathering and storing the sheet bundle while letting the sheet bundle stand in the substantially vertical direction and directing the end face applied with the adhesive down. Thus, in the image formation processing system, the sheet bundle which is applied with the adhesive and bound is stored and gathered while being allowed to stand in the substantially vertical direction with the end face applied with the adhesive down. In this way, since the direction in which the adhesive applied to the sheet bundle drips due to gravity is different from (substantially perpendicular to) the direction in which the sheet bundles are gathered, even if the adhesive drips in the storage portion, it is possible to prevent the dripped adhesive from boding sheet bundles.

Furthermore, the bookbinding section includes conveying the sheet bundle along a substantially vertical transport path from the adhesive applying portion to the storage portion, while letting the sheet bundle stand in the substantially vertical direction. Thus, in the image formation processing system, the sheet bundle is conveyed from the adhesive applying portion to the storage portion along the substantially vertical transport path, while being allowed to stand in the substantially vertical direction. In other words, the sheet bundle is conveyed along only the substantially vertical straight-line transport path over generally all the processes of the bookbinding processing, without being conveyed in various directions such as the vertical, horizontal and oblique directions in the bookbinding section. Therefore, it is not necessary to secure space to convert a posture of the sheet bundle in the bookbinding section, and an area occupied by the transport path for the sheet bundle is remarkably reduced in the bookbinding section, as compared with the conventional bookbinding section that conveys the sheet bundle in various directions such as the vertical, horizontal and oblique directions. Accordingly, it is possible to miniaturize the bookbinding section and largely reduce the manufacturing cost of the bookbinding section. Further, the sheet bundle is maintained while being allowed to stand in the substantially vertical direction during transport from the adhesive applying portion to the storage portion, and therefore, does not crumble.

The bookbinding section is further characterized by conveying the sheet bundle with the end face applied with the adhesive down. Thus, since the sheet bundle is conveyed with the end face down on which the adhesive is coated, it does not happen that the adhesive is removed due to the fact that the end face of the sheet bundle comes into contact with the transport path while the sheet bundle is moved, without particularly securing large space for the transport path, or without providing specific equipment for precisely controlling an application amount of the adhesive. Accordingly, without resulting in increases in size and cost of the apparatus, it is possible to bond sheets constituting the sheet bundle with reliability and bond the sheet bundle and the front cover adequately. Further, such a failure does not occur that the adhesive adhered to the side wall of the transport path prevents transport of subsequent sheet bundles. Moreover, by facing the end face coated with the adhesive downwardly, it is possible to apply the adhesive from under the end face, and the adhesive container can be released upwardly. Therefore, it is also made possible to replenish the adhesive in the adhesive container in the gravity direction, facilitating replenishment of the adhesive.

The image formation processing system according to the invention has achieved implementation of a series of bookbinding processing including the gluing processing in a shorter time with higher efficiency and more reliability as compared to conventional apparatuses.

BRIEF DESCRIPTION OF THE DRAWINGS

FIG. 5(B) shows the cutting portion and the flapper at the time of cutting.

DETAILED DESCRIPTION OF THE PREFERRED EMBODIMENTS

Figure 1:
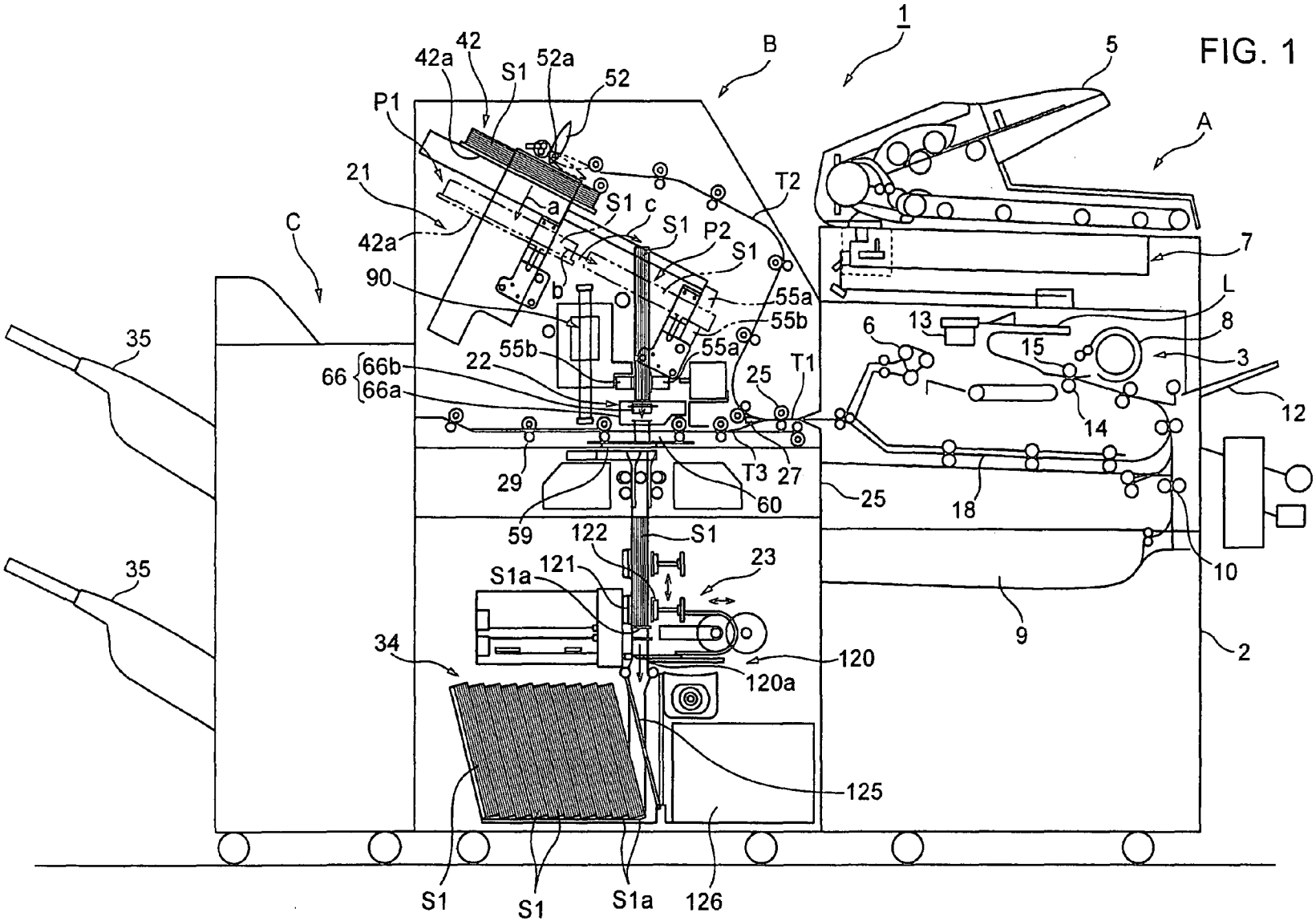
FIG. 1 is a view showing a schematic configuration of an image formation processing system according to one embodiment of the present invention.

Embodiments of the present invention will specifically be described below with reference to accompanying drawings FIG. 1 shows a bookbinding formation processing system 1 according to one embodiment of the invention provided with a copy machine A (sheet supplying means), a bookbinding apparatus (bookbinding section) B disposed downstream of the copy machine A in sheet transport, and a post-processing apparatus (post-processing portion) C disposed downstream of the bookbinding apparatus B in sheet transport which constitute an image formation processing system according to the invention. The bookbinding apparatus B receives a plurality of sheets with images transferred thereto from the copy machine A, gathers the received sheets in the shape of a bundle to form a sheet bundle, and binds the sheet bundle. The post-processing apparatus C has a discharge tray 35, receives a plurality of sheets with images transferred thereto from the copy machine A via the bookbinding apparatus B, and forms a sheet bundle while performing post-processing such as stapling processing (binding processing). In addition, the copy machine A and the bookbinding apparatus B can be used alone.

As shown in the figure, an image formation portion 3 is provided in an apparatus body 2 of the copy machine 1, and forms an image on a sheet such as ordinary paper and OHP. More specifically, an original feeding device 5 is mounted on an upper face of the apparatus body 2, an original automatically fed from the original feeding device 5 is read optically by optically reading means 7, and the read information is transmitted to the image formation portion 3 as a digital signal. In the image formation portion 3, based on the digital signal, light irradiating means 13 irradiates a surface of a photosensitive drum 15 with laser light L, and an electrostatic latent image corresponding to the original is formed on a surface of the photosensitive drum 15. Then, by rotation of the photosensitive drum 15, toner is supplied to the electrostatic latent image from a developing device 8 disposed around the photosensitive drum 15, and the electrostatic latent image is visualized. The visualized toner image is then transferred to a sheet S that is fed to a transfer portion 14 at predetermined timing. The sheet S to transfer to the image is fed to the transfer portion 14 for each sheet from a sheet cassette 9 installed under the apparatus body 2 by a feeding roller 10. The sheet can be fed also from a multi-tray 12.

The sheet S to which the toner image is transferred in the transfer portion 14 is conveyed to a fixing device 6, and the toner image undergoes permanent fixing by application of heat and pressure in the device 6. When a one-side mode is set in the apparatus body 2, the sheet S passed through the fixing device 6 is fed to the bookbinding apparatus B. Meanwhile, when a both-side mode is set in the apparatus body 2, the sheet S with the image formed on its one side is conveyed to a re-transport path 18 by switch back after being passed through the fixing device 6, conveyed to the image formation portion 3 again, where an image is formed on the other side, and is fed to the bookbinding apparatus B.

In addition, in order to enable the bookbinding apparatus B to beforehand perform switching between transport paths and the like, the apparatus body 2 transmits a signal of sheet size and the like to the bookbinding apparatus B before feeding the sheet S to the bookbinding apparatus B.

The bookbinding apparatus B is provided with at least a transport aligning portion 21 that conveys and aligns the sheet S, an adhesive applying portion 22 and a cutting portion 23, and capable of selecting an adhesion bookbinding mode and a cutting mode, as well as an ordinary discharge mode. In addition, cutting in the cutting mode is allowed in three directions except a bonded face of the sheet bundle S1 described later.

The transport aligning portion 21 is provided with a first transport path (transport means) T1 that conveys the sheet S carried from the apparatus body 2, and a second transport path (transport means) T2 and third transport (transport means) path T3 that are branched from the first transport path T1. The first transport path T1 is provided with a carry-in roller pair 25, and a switching flapper 27 to switch between transport paths is provided at a branching portion of the second transport path T2 and the third transport path T3 downstream of the carry-in roller pair 25.

In such a form of transport paths, when the ordinary discharge mode is selected in the apparatus body 2, the sheet S carried into the bookbinding apparatus B from the apparatus body 2 via the first transport path T1 is guided to the third transport path T3 by the switching flapper 27, and discharged to the discharge tray 35 of the post-processing apparatus C via a plurality of feeding roller pairs 29 provided on the third transport path T3 (when necessary, discharged to the discharge tray 35 after undergoing the post-processing such as stapling). Meanwhile, when the bookbinding mode is selected in the apparatus body 2, the sheet S is guided to the second transport path T2 by the switching flapper 27, undergoes bonding bookbinding (for example, bookbinding by gluing) via the adhesive applying portion 22 and the cutting portion 23, and then, discharged to the storage portion 34.

Downstream of the second transport path T2 is provided a gathering portion 42 constituting an aligning region of the transport aligning portion 21. The gathering portion 42 is provided with a receiving portion 42*a* that receives the sheet S, a predetermined number of sheets S are placed while being inclined on the receiving portion 42*a*, and a single sheet bundle S1 is thereby formed. In this case, the receiving portion 42*a* is slidable in the placement direction of the sheet S (the thickness direction of the sheet bundle S1) by a sliding mechanism not shown, and fixed to an arbitrary slide position by a rack not shown, for example. The gathering portion 42 is further provided with a pressing arm 52 that presses the sheet S against the receiving portion 42*a* and that is rotatable on a rotation axis 52*a*.

After the predetermined sheet bundle S1 is formed on the receiving portion 42*a*, the portion 42*a* is shifted a predetermined distance downwardly toward a first position P1 while maintaining the inclined posture to hold the sheets as shown by the arrows a and b in FIG. 1, and then, positioned in a second position P2 by being shifted a predetermined distance in the direction perpendicular to the first shift direction (in a downwardly slanting direction). Such shifts of the receiving portion 42*a* are carried out by a shift mechanism not shown specifically.

In the second position P2 are provided grippers 55*a* and 55*b* that hold end portions of the sheet bundle S1 placed on the receiving portion 42*a*. The grippers 55*a* and 55*b* rotate the held sheet bundle S1 as shown by the arrow c in FIG. 1 to direct to a substantially vertical direction (let the sheet bundle S1 stand in the substantially vertical direction), and shift the sheet bundle S1 downwardly toward the adhesive applying portion 22 while keeping the substantially vertical state (with one end face (to which an adhesive is applied as described later) of the sheet bundle S1 down). More specifically, these grippers 55*a* and 55*b* are allowed to move between a holding position to hold the sheet bundle S1 in the second position P2 and a passing position to pass the sheet bundle S1 to the cutting device 23. Further, the grippers 55*a* and 55*b* are allowed to move between a close position to hold the sheet bundle S1 from both sides and an open position to release the holding state of the sheet bundle S1.

The case will be described below where the gathering portion 42 gathers sheets S to form the sheet bundle S1.

When the bookbinding mode is selected on the apparatus body 2 side, the sheet S discharged from the apparatus body 2 is guided to the second transport path T2 from the first transport path T1 via the carry-in roller pair 25 and the switching flapper 27, and then guided to the gathering portion 42.

The sheet S guided to the gathering portion 42 is placed on the receiving portion 42*a* successively. In this case, whenever a single sheet S is placed on the receiving portion 42*a*, the pressing arm 52 rotates on the rotation axis 52*a*, and presses the sheet S against the receiving portion 42*a*. The pressing force by the pressing arm 52 eliminates clearance between sheets S, forms an appropriate sheet bundle S1, and slides the receiving portion 42*a* together with the sheet bundle S1. The slide position of the receiving portion 42*a* is held by the rack mechanism, thereby reserving placement space for a next sheet S. In other words, as the number of sheets S gathered in the gathering portion 42 is increased (corresponding to the thickness of the sheet bundle S1), the pressing arm 52 slides the receiving portion 42*a*, and thus contributes to formation of the sheet bundle S1 with excellent alignment.

As described above, the sheet S is fed in the gathering portion 42 successively, and when a predetermined number of sheets S are gathered (a sheet bundle S1 with a predetermined thickness is formed), the receiving portion 42*a* is shifted to the second position P2 via the first position P1 by the shift mechanism. Then, in the second position P2, the sheet bundle S1 on the receiving portion 42*a* is held by the grippers 55*a* and 55*b* waiting in the open position, then rotated to the vertical direction, and shifted to the adhesive applying portion 22 while keeping the vertical state. In addition, the adhesive applying portion 22 is provided between the front cover bonding portion 60 provided downstream of the third transport path T3 described later and the second position P2.

The adhesive applying portion 22 is provided with an adhesion unit 66 that holds an adhesive (for example, glue) and applies the held adhesive to the end face of the sheet bundle S1, and a shift mechanism that shifts the adhesion unit 66 along the end face of the sheet bundle S1. The adhesion unit 66 is provided with, for example, an aluminum container (adhesive container) 66*a* that stores an adhesive and has an upward opening, and an application roller 68*b* as a rotation member rotatably supported by the container 66*a*. In this case, the application roller 68*b* is comprised of, for example, heat-resistant rubber, comes into contact with the adhesive inside the container 66*a* to hold on its surface, and applies the adhesive held on the surface to the end face of the sheet bundle S1 while rotating.

The adhesion unit 66 is allowed to move by the shift mechanism among an application region (region in which the container 66*a* is positioned in FIG. 1) to apply the adhesive to the sheet bundle S1, a standby position to prepare for application processing after withdrawing from the transport path (substantially vertical transport path) of the sheet bundle S1, and a replenishment position to undergo replenishment of the adhesive (the adhesive is added through the opening of the container 66*a*) i.e. a position opposed to an adhesive replenishing device 90.

The case will be described below that the adhesive applying portion 22 applies the adhesive to the end face of the sheet bundle S1 fed by the grippers 55*a* and 55*b*.

The sheet bundle S1, which is descending while being sandwiched by the grippers 55*a* and 55*b* as described earlier, is positioned in a substantially vertical state in a predetermined position in the application region on the movement path of the adhesion unit 66. In this case, the clearance between the end face of the sheet bundle S1 and the application roller 68*b* is adjusted corresponding to the thickness of the sheet bundle S1.

When the sheet bundle S1 is thus positioned in the predetermined position in the application region, the adhesion unit 66 waiting in the standby position is next moved to a predetermined starting position in the application region. Then, the adhesion unit 66 is moved from the starting position to a predetermined return position on the sheet bundle S1 with the forwardly rotated application roller 68*b* brought into contact with the end face of the sheet bundle S1. The end face of the sheet bundle S1 is thus coated with the adhesive uniformly by the application roller 68*b* bearing the adhesive inside the container 66*a* on its surface.

When the adhesion unit 66 reaches the return position, the forward rotation of the application roller 68*b* is halted, and the movement of the adhesion unit 66 is also halted. From this point, the application roller 68*b* is reversely rotated next, and the adhesion unit 66 starts moving to the starting position from the return position. Then, when the adhesion unit 66 reaches the starting position again, the reverse rotation of the application roller 68*b* is halted, and the movement of the adhesion unit 66 is halted. Then, after the aforementioned reciprocating movement is carried out, for example, twice, the adhesive application operation is finished.

After finishing the application of adhesive to the end face of the sheet bundle S1, the adhesion unit 66 is moved to the standby position or the replenishment position to reserve the transport path for the sheet bundle S1. Subsequently, the sheet bundle S1 held by the grippers 55*a* and 55*b* descends to the front cover bonding portion 60 via the substantially vertical transport path (in the direction crossing the movement direction of the adhesion unit 66).

Meanwhile, a front cover has already been conveyed to the front cover bonding portion 60 and on standby until after the adhesive is thus applied to the end face of the sheet bundle S1. In this case, the front cover may be created in the apparatus body 2 and then fed to the front cover bonding portion 60 from the apparatus body 2, or may drawn from an inserter 100 as the front cover supplying means provided between the copy machine A and the bookbinding apparatus B and fed to the front cover bonding portion 60. When the front cover is fed from the apparatus body 2 or the inserter 100 to the front cover bonding portion 60, the front cover is conveyed to the third transport path T3 from the first transport path T1 via the switching flapper 27, and positioned in a predetermined position in the front cover bonding portion 60 crossing the substantially vertical transport path of the sheet bundle S1. Then, the end face of the sheet bundle S1 applied with the adhesion is pressed against the positioned front cover vertically from above the front cover by the grippers 55*a* and 55*b*. In this state, the sheet bundle S1 is further moved in the vertically downward direction by the grippers 55*a* and 55*b* with the front cover bonded to the end face by the adhesive, and pressed against a slidable striking block plate 59 located under the front cover bonding portion 60. Then, the front cover and the sheet bundle S1 are pressed from both sides by a slidable back folding plate while being pressed against the striking block plate 59. Folds are thereby formed in the front cover corresponding to the thickness of the sheet bundle S1.

Next, the striking block plate 59 slides to the external side to form the transport path for the sheet bundle S1, and then the grippers 55*a* and 55*b* pass the sheet bundle S1 with the front cover bonded thereto to the cutting portion 23 located downward while holding the bundle S1.

The cutting portion 23 will specifically be described below with reference to FIGS. 2 to 5.

Figure 2:
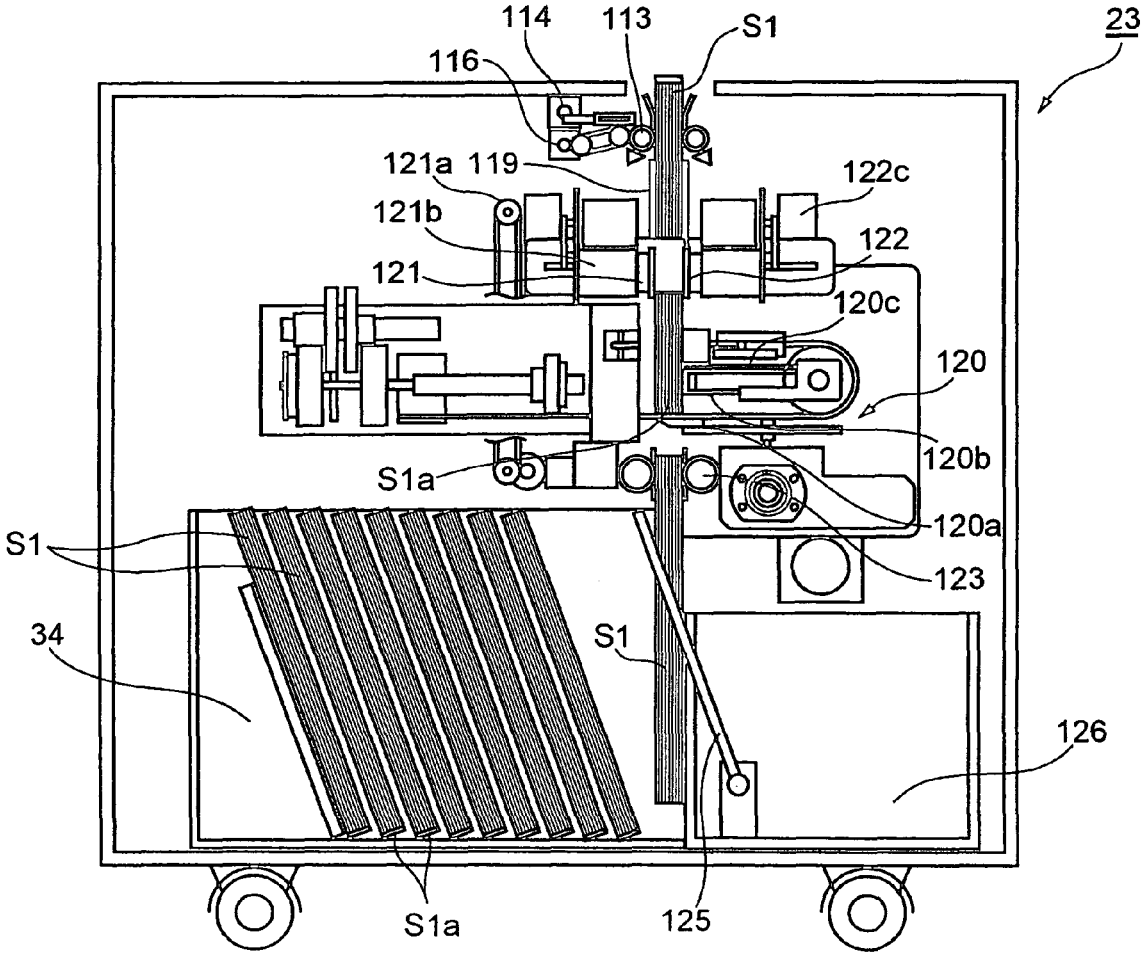
FIG. 2 is a view showing a schematic configuration of a cutting portion of a bookbinding apparatus constituting part of the image formation processing system.
Figure 3:
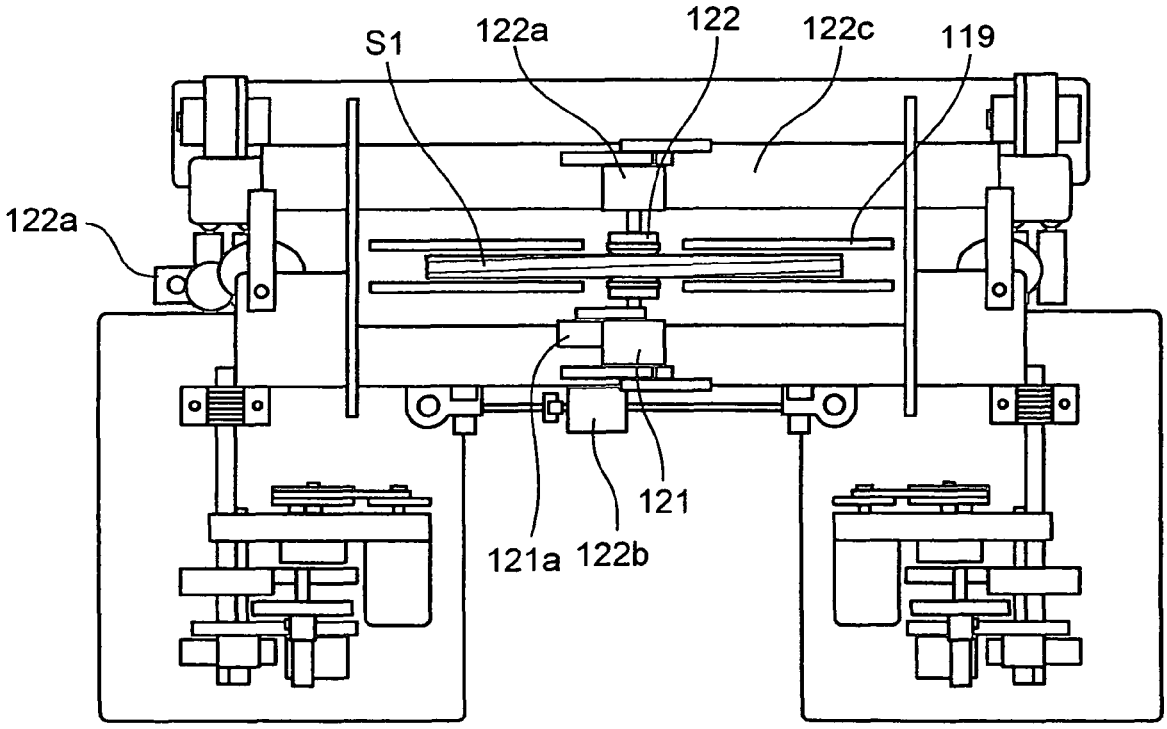
FIG. 3 is a plan view of the cutting portion of FIG. 2.
Figure 4:
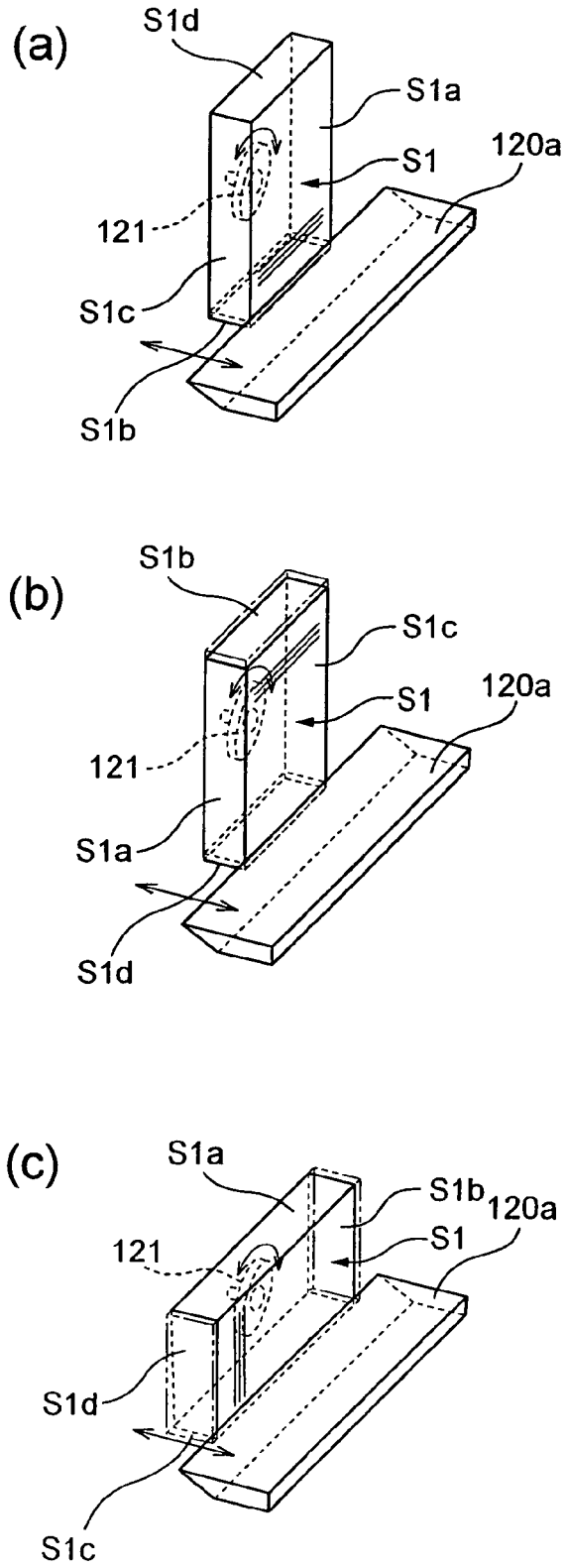
FIG. 4 is a perspective view illustrating steps of cutting procedure by a cutting blade.
Figure 5:
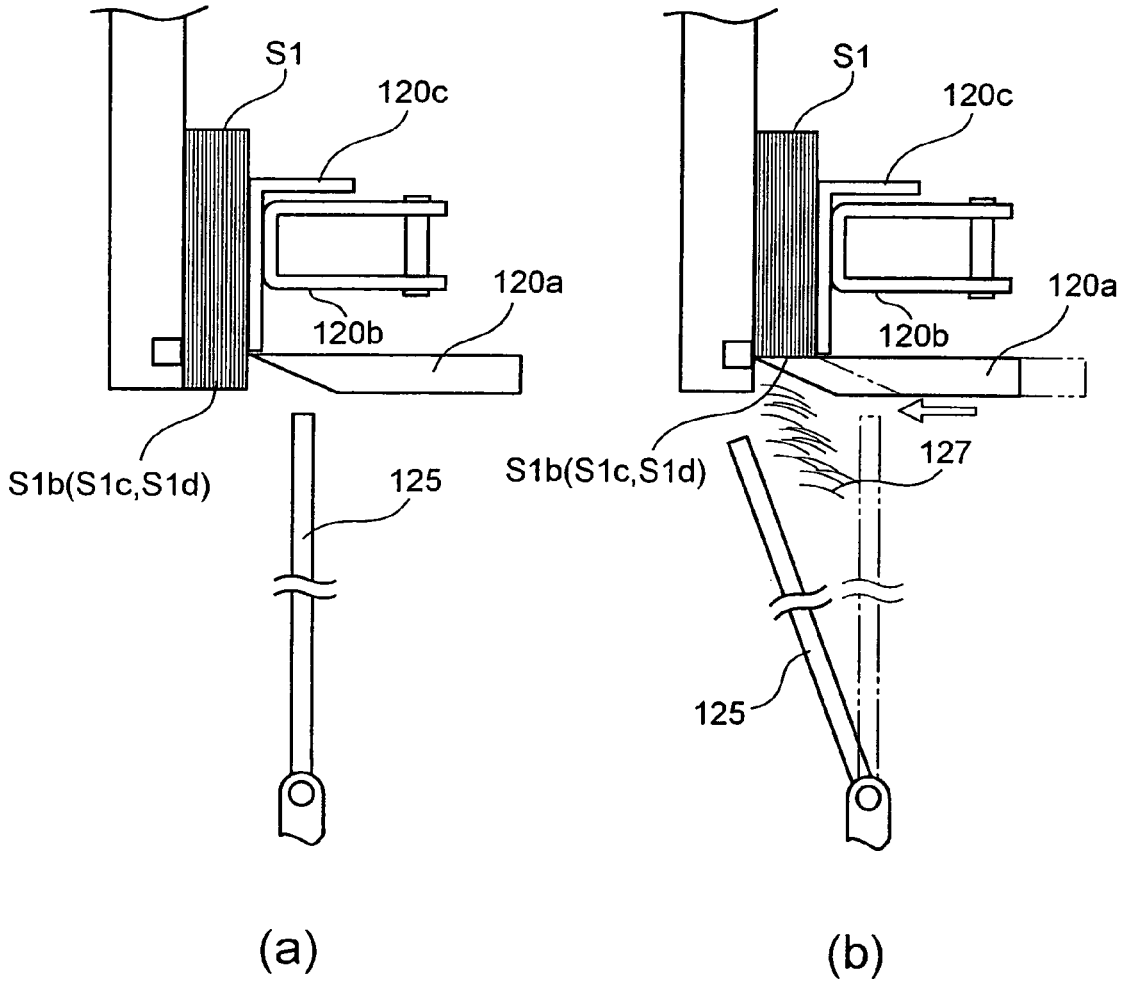
FIG. 5(*a*) shows the cutting portion and a flapper prior to cutting.

In FIGS. 2 and 3, "113" denotes an inlet transport roller, "120" denotes a cutting unit, "121" denotes a rotation table, "122" denotes a rotatable gripper that holds and fixes the sheet bundle S1 on the rotation table 121, "122*a*" is a gripper driving mechanism that presses the gripper 122 against the rotation table 121, "122*b*" is a gripper shift mechanism that shifts the gripper 122 in the direction of the cutting unit 120, and "122*c*" is a gripper frame that holds the gripper 122. The cutting unit 120 is provided with a cutting blade 120*a*, a movable pressing plate 120*b* that presses an edge portion of the sheet bundle S1 in cutting, a fixed pressing plate 120*c*, and a pressing plate shift mechanism that drives the plates.

When the sheet bundle S1 with the front cover bonded thereto is passed to the cutting portion 23 by the grippers 55*a* and 55*b*, a transport shift mechanism 116 is started to rotate the inlet transport roller 113, and the sheet bundle S1 is conveyed toward the cutting blade 120*a* in the vertical direction. In this case, the inlet transport roller 113 holds the sheet bundle S1 by being driven by a roller open/close shift mechanism 114.

Next, the sheet bundle S1 discharged from the inlet transport roller 113 is conveyed to the cutting blade 120*a* still in the vertical state, while being supported by guide plates 119 forming a substantially vertical transport path.

When the sheet bundle S1 is thus conveyed and reaches the cutting blade 120*a*, the gripper 122 is driven by the gripper driving mechanism 122*a*, and the sheet bundle S1 is held and fixed between the gripper 122 and the rotation table 121.

Next, based on thickness information of the sheet bundle S1, the cutting blade 120*a* moves to a predetermined position to form clearance required for the sheet bundle S1 to rotate and shift, and waits. Then, the rotation table 121 and the gripper 122 are driven via the gripper shift mechanism 122*b* and a rotation mechanism 121*a*, whereby the sheet bundle S1 held by the rotation table 121 and the gripper 122 is rotated and shifted from a state in which a back S1*a* as the end face to which the front cover is bonded faces downward to respective positions enabling the cutting blade 120*a* to cut the other end faces, an upside portion S1*b*, an end portion S1*c* and a downside portion S1*d*. In addition, FIG. 4(*a*) shows a state where the sheet bundle S1 is rotated and shifted to a position for the cutting blade 120*a* to cut the upside portion S1*b*, FIG. 4(*b*) shows a state where the sheet bundle S1 is rotated and shifted to a position for the cutting blade 120*a* to cut the downside portion S1*d*, and FIG. 4(*c*) shows a state where the sheet bundle S1 is rotated and shifted to a position for the cutting blade 120*a* to cut the end portion S1*c*.

In either case of cutting the end face S1*b*, S1*c* or S1*d*, the sheet bundle S1 held by the rotation table 121 and the gripper 122 is fixed to the cutting position, and the cutting unit 120 cuts the end face by control means not shown. More specifically, the control means drives the pressing plate moving mechanism, the movable pressing plate 120*b* is thereby moved, and an end face side of the sheet bundle S1 to be cut is held between the movable pressing plate 120*b* and the fixed pressing plate 120*b* (see FIG. 5(*a*)). Then, the cutting blade 120*a* is moved along an arc on the horizontal plane, and the end face is thereby cut and aligned (see FIG. 5(*b*)). At this point, cut waste 127 drops due to its own weight, and is stored in a waste box 126 by a flapper 125. More specifically, when the cutting is started, the control means (not shown) rotates the flapper 125 to a waste receiving position shown by solid lines in FIG. 5(*b*), and the cut waste 127 dropping under its own weight during cutting is stored in the waste box 126 by guide of the flapper 125. Such efficient collection of the cut waste 127 can be implemented due to the fact that the sheet bundle S1 is conveyed by the vertical transport path and cut. In addition, the flapper 125 is moved back to the original position (the position shown by solid lines in FIG. 5(*a*); the position shown by dashed lines in FIG. 5(*b*) whenever cutting of a single sheet bundle S1 is finished.

After one end face is cut, based on the thickness information of the sheet bundle S1, the pressing plate 120*b* and the cutting blade 120*a* move again to predetermined positions to form clearance required for the sheet bundle S1 to rotate and shift, and wait. Then, the rotation table 121 and the gripper 122 are driven again via the gripper shift mechanism 122*b* and the rotation mechanism 121*a*, and the sheet bundle S1 held by the rotation table 121 and the gripper 122 is rotated (by 180°) and moved to a position enabling the cutting blade 120*a* to cut an end face to cut next.

When cutting of the three end faces is finished as described above, the rotation mechanism 121*a* is driven to move the rotation table 121 back to the original position, the gripper shift mechanism 122*b* is driven, and thereby, the sheet bundle S1 held by the gripper 122 and the rotation table 121 is conveyed to the storage portion 34 via a discharge roller 123. In this case, the sheet bundle S1 discharged from the discharge roller 123 is pushed into the storage portion 34 by the flapper 125, and stored and gathered while being allowed to stand substantially vertically with the end face S1*a* coated with the adhesive down.

As described above, according to the image formation processing system of this embodiment, the adhesive applying portion 22 is disposed downstream of the copy machine A as the image formation portion in sheet transport, while the post-processing apparatus C as the post-processing portion is disposed downstream of the adhesive applying portion 22 in sheet transport. Accordingly, a sheet S fed out from the copy machine A side is directly supplied to the adhesive applying portion 22 without troubling to pass through the post-processing apparatus C, and it is thereby possible to reduce the time taken to convey the sheet S from the copy machine A to the adhesive applying portion 22, and shorten the time required for the entire adhesive applying processing. In other words, it is possible to perform the adhesive applying processing in a shorter time with higher efficiency than in conventional systems. Further, since the sheet transport path from the copy machine A to the adhesive applying portion 22 is shorter than in conventional systems, it is made possible to significantly reduce the risk of occurrences of the so-called jam such that a sheet is blocked during transport, and reliable adhesive applying processing can be implemented, while preventing a sheet from being wasted due to the jam.

The aforementioned constitution is particularly useful in the case, like this embodiment, where the adhesive applying portion 22 constitutes part of the bookbinding apparatus B that binds the sheet bundle, and the bookbinding apparatus B includes the cutting portion 23 that cuts an end face of the sheet bundle, and the storage portion 34 that gathers and stores the sheet bundle that is bound and cut in the cutting portion 23, i.e. adhesive applying portion 22 requires long processing time in association with a series of bookbinding processing including cutting and storage.

Further in this embodiment, the front cover bonding portion 60 bonds a front cover to the end face of the sheet bundle S1 applied with the adhesive, while letting the sheet bundle S1 stand in the substantially vertical direction. In this way, since such bonding can be carried out that the sheet bundle S1 is pressed against the front cover with the end face applied with the adhesive down, even if the adhesive drips, the adhesive is received on the front cover, and the risk is eliminated of occurrences of trouble due to the adhesive adhering to other parts of the apparatus.

Furthermore, in the image formation processing system according to this embodiment, the cutting portion 23 cuts the end face of the sheet bundle S1 while letting the sheet bundle S1 stand in the substantially vertical direction. Thus, when the sheet bundle applied with the adhesive is cut while being allowed to stand in the substantially vertical direction, the direction (vertical direction) of the adhesive dripping due to gravity is perpendicular to the cutting direction (shift direction) of a cutting blade. Accordingly, as compared to the case where the adhesive dripping direction agrees with the cutting direction (shift direction) of the cutting blade (the case where the sheet bundle is cut while being allowed to lie horizontally), occasions can be reduced extremely such that the adhesive dripped in cutting adheres to the cutting blade, and it is made possible to minimize such an event that the adhered adhesive degrades subsequent cutting function of the cutting blade.

Moreover, in the image formation processing system of this embodiment, the sheet bundle S1 that is applied with the adhesive and bound is gathered and stored in the storage portion 34 while standing in the substantially vertical direction and directing the end face applied with the adhesive down. In this way, since the direction in which the adhesive applied to the sheet bundle S1 drips due to gravity is different from (substantially perpendicular to) the direction in which the sheet bundles S1 are gathered, even if the adhesive drips in the storage portion 34, it is possible to prevent the dripped adhesive from boding sheet bundles S1.

Further, in the image formation processing system of this embodiment, the sheet bundle S1 is conveyed along the substantially vertical transport path from the adhesive applying portion 22 to the storage portion 34, while being allowed to stand in the substantially vertical direction. In other words, the sheet bundle S1 is conveyed along only the substantially vertical straight-line transport path over generally all the processes of the bookbinding processing, without being conveyed in various directions such as the vertical, horizontal and oblique directions in the bookbinding apparatus B. Therefore, it is not necessary to secure space to convert a posture of the sheet bundle S1 in the bookbinding apparatus B, and an area occupied by the transport path for the sheet bundle S1 is remarkably reduced in the bookbinding apparatus B, as compared with the conventional bookbinding apparatus that conveys the sheet bundle S1 in various directions such as the vertical, horizontal and oblique directions. Accordingly, it is possible to miniaturize the bookbinding apparatus B and largely reduce the manufacturing cost of the bookbinding apparatus B. Further, the sheet bundle S1 is maintained while being allowed to stand in the substantially vertical direction during transport from the adhesive applying portion 22 to the storage portion 34, and therefore, does not crumble.

Furthermore, in the image formation processing system of this embodiment, since the sheet bundle S1 is conveyed with the end face down on which the adhesive is coated, it does not happen that the adhesive is removed due to the fact that the end face of the sheet bundle S1 comes into contact with the transport path while the sheet bundle S1 is moved, without particularly securing large space for the transport path, or without providing specific equipment for precisely controlling an application amount of the adhesive. Accordingly, without resulting in increases in size and cost of the apparatus, it is possible to bond sheets constituting the sheet bundle S1 with reliability and bond the sheet bundle S1 and the front cover adequately. Further, such a failure does not occur that the adhesive adhered to the side wall of the transport path prevents transport of a subsequent sheet bundle S1. Moreover, by facing the end face coated with the adhesive downwardly, it is possible to apply the adhesive from under the end face, and the adhesive container **66*a* can be released upwardly. Therefore, it is also made possible to replenish the adhesive in the adhesive container 66*a*** in the gravity direction, facilitating replenishment of the adhesive.

Figure 6:
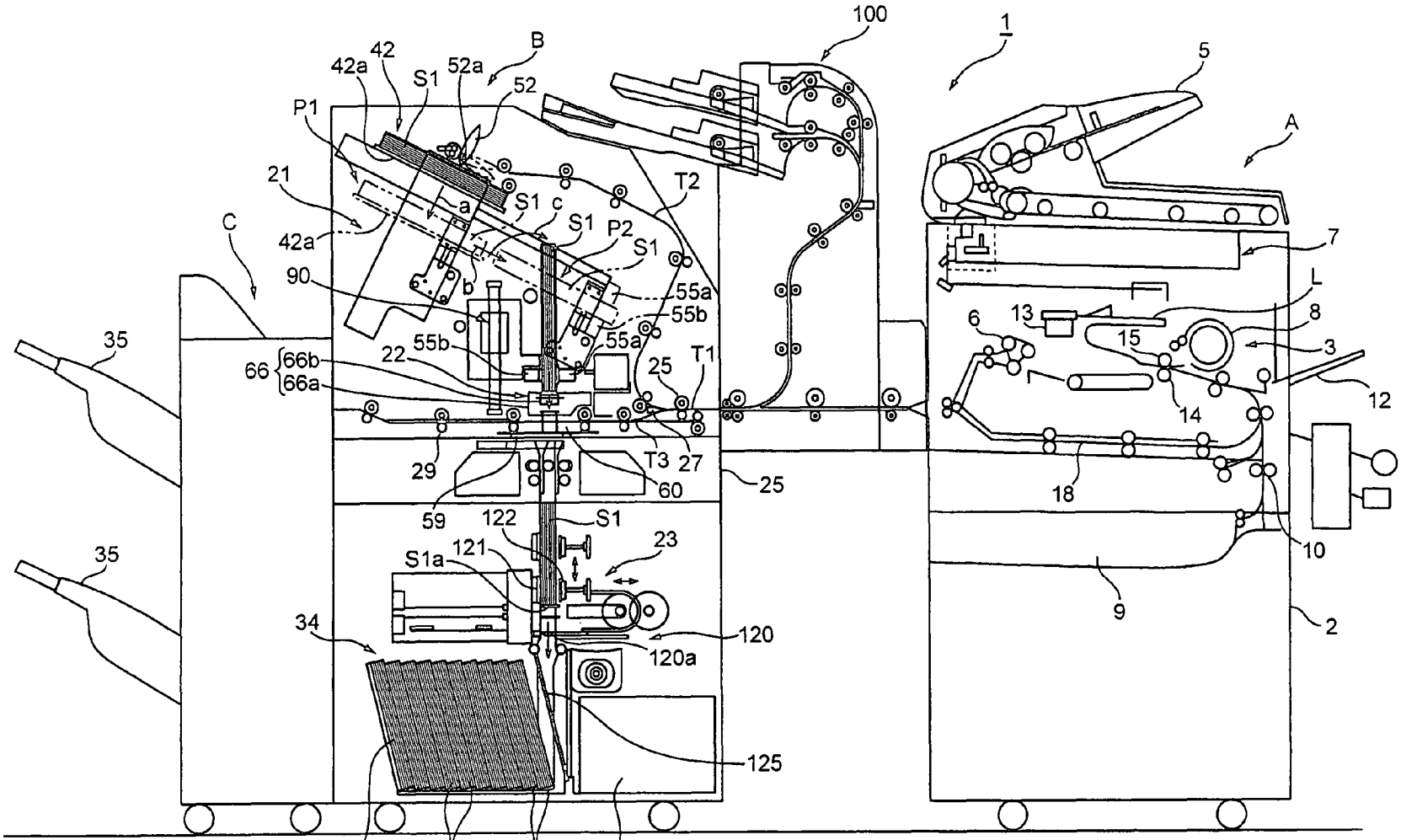
FIG. 6 shows a modification of the image formation processing system with an inserter between a copy machine and the bookbinding apparatus.

The present invention is not limited to the above-described embodiment, and various variations and modifications may be possible without departing from the scope of the present invention. For example, in the above-mentioned embodiment, a plurality of sheets is supplied from the copy machine A to the bookbinding apparatus B to form a sheet bundle. As shown in FIG. 6, however, a plurality of sheets with images already added thereto may be supplied from the inserter (sheet supplying portion) 100 to the bookbinding apparatus B to form a sheet bundle. Also in this case, the bookbinding apparatus B is disposed downstream of the inserter 100 in sheet transport, and the post-processing apparatus C is disposed downstream of the bookbinding apparatus B in sheet transport.

The present invention is applicable to various systems having such an apparatus that forms a bundle of sheets received from an image formation portion and that applies an adhesive to the bundle.

What is claimed is:

1. An image formation processing system comprising:

an image formation portion that forms images on unbundled individual sheets;

an adhesive applying portion which receives a plurality of unbundled individual sheets with images transferred thereto from the image formation portion, gathers the received sheets in the shape of a bundle to form a sheet bundle, applies an adhesive to an end face of the sheet bundle, and comprises a front cover bonding portion that bonds a front cover to the end face of the sheet bundle applied with the adhesive, the adhesive applying portion being configured to optionally convey unbundled individual sheets therethrough;

a post-processing portion which receives via the adhesive applying portion a plurality of unbundled individual sheets with images transferred thereto from the image formation portion, gathers the received unbundled individual sheets downstream from the adhesive applying portion into a bundle to form a sheet bundle, and performs one or more of stapling-processing and punching-processing on the sheet bundle; and transport means which conveys a plurality of unbundled individual sheets and the front cover from the image formation portion selectively to one of the adhesive applying portion and the post-processing portion, and conveys the front cover to the front cover bonding portion crossing a substantially vertical bonding position path such that the end face of the sheet bundle with the adhesive applied thereto is pressed against the front cover vertically from above;

wherein the adhesive applying portion is disposed downstream of the image formation portion in sheet transport, while the post-processing portion is disposed downstream of the adhesive applying portion in sheet transport.

2. An image formation processing system comprising:

an image formation portion that forms images on unbundled individual sheets;

an adhesive applying portion which receives a plurality of unbundled individual sheets with images transferred thereto from the image formation portion, gathers the received sheets in the shape of a bundle to form a sheet bundle, applies an adhesive to an end face of the sheet bundle, and comprises a front cover bonding portion that bonds a front cover to the end face of the sheet bundle applied with the adhesive, the adhesive applying portion being configured to optionally convey unbundled individual sheets therethrough;

a post-processing portion which receives via the adhesive applying portion a plurality of unbundled individual sheets with images transferred thereto from the adhesive applying portion, gathers the received unbundled individual sheets downstream from the adhesive applying portion into a bundle to form a sheet bundle, and performs predetermined post-processing on the sheet bundle; and transport means which conveys a plurality of unbundled individual sheets and the front cover from the image formation portion selectively to one of the adhesive applying portion and the post-processing portion, and conveys the front cover to the front cover bonding portion crossing a substantially vertical bonding position path such that the end face of the sheet bundle with the adhesive applied thereto is pressed against the front cover vertically from above;

wherein the adhesive applying portion is disposed downstream of the image formation portion in sheet transport, while the post-processing portion is disposed downstream of the adhesive applying portion in sheet transport; and a cutting portion that cuts an end face of the sheet bundle formed by the adhesive applying portion.

3. The image formation processing system according to claim 2, wherein the cutting portion cuts the end face of the sheet bundle while letting the sheet bundle stand in the substantially vertical direction.

4. The image formation processing system according to claim 2, wherein the storage portion gathers and stores the sheet bundle while letting the sheet bundle stand in the substantially vertical direction and directing the end face applied with the adhesive down.

5. The image formation processing system according to claim 2, wherein the front cover bonding portion bonds a front cover to the end face of the sheet bundle applied with the adhesive, while letting the sheet bundle stand in the substantially vertical direction.

6. The image formation processing system according to claim 2, wherein the sheet bundle is conveyed along a substantially vertical transport path from the adhesive applying portion to the storage portion, while letting the sheet bundle stand in the substantially vertical direction.

7. The image formation processing system according to claim 2, wherein the sheet bundle is conveyed with the end face applied with the adhesive down.

8. The image formation processing system according to claim 2, wherein a front cover created in the image formation portion is supplied to the front cover bonding portion.

9. The image formation processing system according to claim 2, further comprising:

front cover supplying means, provided independently of the image formation portion, for supplying a front cover to the front cover bonding portion.

10. The image formation processing system according to claim 2, further including a storage portion that gathers and stores the sheet bundle that is bound and cut in the cutting portion.

11. An image formation processing system comprising:

an image formation portion that forms images on unbundled individual sheets;

an adhesive applying portion which receives a plurality of unbundled individual sheets from the image formation portion, gathers the received unbundled individual sheets in the shape of a bundle to form a sheet bundle, applies an adhesive to an end face of the sheet bundle, and comprises a front cover bonding portion that bonds a front cover to the end face of the sheet bundle applied with the adhesive, the adhesive applying portion being configured to optionally convey unbundled individual sheets therethrough;

a post-processing portion which is configured to receive via the adhesive applying portion a plurality of unbundled sheets with images transferred thereto from the image formation portion and to gather the received plurality of unbundled sheets into a bundle to form a sheet bundle, and performs predetermined post-processing on the sheet bundle; and transport means which conveys a plurality of unbundled individual sheets and the front cover from the image formation portion selectively to one of the adhesive applying portion and the post-processing portion, and conveys the front cover to the front cover bonding portion crossing a substantially vertical bonding position path such that the end face of the sheet bundle with the adhesive applied thereto is pressed against the front cover vertically from above;

wherein the adhesive applying portion is disposed downstream of the image formation portion in sheet transport and the post-processing portion is disposed downstream of the adhesive applying portion in the sheet transport.

* * * * *